US005240522A

United States Patent [19]

Tanaka et al.

[11] Patent Number: 5,240,522

[45] Date of Patent: Aug. 31, 1993

[54] METHOD OF PRODUCING HARDENED ALUMINUM ALLOY SHEETS HAVING SUPERIOR THERMAL STABILITY

[75] Inventors: Hiroki Tanaka; Shin Tsuchida, both of Nagoya, Japan

[73] Assignee: Sumitomo Light Metal Industries, Ltd., Tokyo, Japan

[21] Appl. No.: 858,197

[22] Filed: Mar. 26, 1992

[30] Foreign Application Priority Data

Mar. 29, 1991 [JP] Japan ..... 3-089317
Jul. 5, 1991 [JP] Japan ..... 3-165661

[51] Int. Cl.[5] ..... C22F 1/04

[52] U.S. Cl. ..... 148/693; 148/697; 148/700; 148/702; 148/415; 148/417; 148/439; 148/440

[58] Field of Search ..... 148/693, 697, 700, 702, 148/415, 417, 439, 440

[56] References Cited

U.S. PATENT DOCUMENTS

| | | | |
|---|---|---|---|
| 3,560,269 | 2/1971 | Anderson et al. | 148/439 |
| 4,284,437 | 8/1981 | Baba et al. | 148/692 |
| 4,526,625 | 7/1985 | Merchant et al. | 148/697 |
| 5,062,901 | 11/1991 | Tanaka et al. | 148/692 |

FOREIGN PATENT DOCUMENTS

| | | |
|---|---|---|
| 0084571 | 8/1983 | European Pat. Off. . |
| 0234044 | 9/1987 | European Pat. Off. . |
| 0413907 | 2/1991 | European Pat. Off. . |
| 57-33332 | 7/1982 | Japan . |
| 2-10214 | 3/1990 | Japan . |

OTHER PUBLICATIONS

Thermal Stability of Commercial Pure Aluminum and AlMg4.5Mn, B. Grzemba et al, Aluminum vol. 65, p. 184 (1989).

*Primary Examiner*—R. Dean
*Assistant Examiner*—Robert R. Koehler
*Attorney, Agent, or Firm*—Flynn, Thiel, Boutell & Tanis

[57] ABSTRACT

The present invention provides a method of producing a hardened aluminum alloy sheet having superior thermal stability, the method comprising the steps of: homogenizing an ingot of an aluminum alloy consisting essentially of, in weight percentage, 3.0 to 6.0% Mg and 0.4 to 0.8% Mn, with the balance being Al and incidental impurities; hot rolling the homogenized ingot to a sheet; cold rolling the hot-rolled sheet at a rolling reduction of at least 20%; intermediate heat treating the cold-rolled sheet at 200° to 250° C. for one hour or more; and final cold rolling the intermediate heat-treated sheet at a reduction of at least 50%. In this process, the aluminum ingot may further contain from 0.05 to 0.4% Cu with or without 0.05 to 0.5% Si, 0.1 to 0.5% Fe, 0.01 to 0.05% Ti and 0.0001 to 0.0010% B. Further, the above homogenizing and hot rolling steps may be replaced by the steps of homogenizing, hot rolling to a sheet thickness of 2 to 6 mm, cold rolling and annealing for recrystallization.

12 Claims, No Drawings

METHOD OF PRODUCING HARDENED ALUMINUM ALLOY SHEETS HAVING SUPERIOR THERMAL STABILITY

BACKGROUND OF THE INVENTION

1. Field of the Invention

The present invention relates to a method of producing aluminum alloy sheet stock especially useful as can end materials for retort cans in which coffee, oolong tea and so forth are preserved. More particularly, the present invention relates to a method of producing hardened aluminum alloy sheets having good formability and high strength which are retained even after baking anticorrosive coating materials or the like, applied to the sheets, at 250° to 300° C., without softening.

2. Description of the Prior Art

When coffee, oolong tea and similar beverage are preserved in cans, the cans are subjected to a certain heat treatment for sterilizing, called "retort-heating" in which the cans are sterilized by heating in a sterilizer, called "a retort". In the present specification, the thus sterilized cans are merely termed "retort cans". Since the retort cans contain therein materials which readily corrode aluminum alloys, their interior surfaces are coated with organic polymer resin coatings having a high corrosion protection effect. As such polymer resin coatings, there are known various types of coatings, such as vinyl resin type, vinyl organosol type, epoxyamino type, epoxyphenol type, epoxyacryl type, etc. When a hardened strip or sheet is subjected to the coating operation, a coating material as set forth above is applied to the strip or sheet using an appropriate coating device, such as roll coater, etc., and heat-treated at 250° to 300° C. in a continuous furnace in order to obtain the properties required as a protective layer.

The following procedures have heretofore been proposed for producing aluminum alloy sheet materials to be fabricated into can ends of retort beverage cans for coffee, oolong tea and the like. An aluminum alloy ingot is homogenized and hot-rolled to a thickness of 3 to 5 mm. Then, the hot-rolled aluminum alloy is fabricated into a hardened sheet having a thickness of 0.4 mm or less by the following steps, namely, (1) cold rolling, intermediate annealing at 300° to 450° C. and final cold rolling to a sheet thickness of 0.4 mm or less; or (2) hot rolling to a sheet thickness of about 2 mm, optionally intermediate annealing at that thickness if necessary, and final cold rolling to a sheet thickness of 0.4 mm or less.

As set forth above, aluminum alloy sheet materials for retort beverage can ends are coated with an organic polymer resin coating, using a roll coater or the like, and heated at a temperature of 250° to 300° C. in a continuous furnace for drying and baking the coating. When the foregoing conventional aluminum alloy sheet materials are subjected to such coating and baking operations, softening occurs in the sheet materials, thereby lowering the strength. Therefore, the conventional materials have great difficulties in reducing their wall thickness and any sufficient thickness reduction cannot be achieved while maintaining their strength at sufficient levels.

SUMMARY OF THE INVENTION

It is accordingly an object of the present invention to provide a method of producing a hardened aluminum alloy sheet having a very high thermal stability.

With a view to solving the above-mentioned problems, the foregoing thermal stability required in the coating and baking stage has been improved by forming fine and uniform precipitates of Al—Mn compounds by addition of Mn or Mn and Cu with or without Si, Fe, Ti and B in combination with low temperature thermal treatments. Further, the strength and formability of the finished sheet product have been investigated in connection with the production procedures and, as a result, found that a hardened sheet having superior strength and formability can be obtained by introducing an additional cold rolling step and a recrystallizing heat-treating step during the production process. The present invention has been accomplished on the basis of such investigation and finding.

The present invention provides a method of producing a hardened aluminum alloy sheet having superior thermal stability, the method comprising the steps of:

homogenizing an ingot of an aluminum alloy consisting essentially of, in weight percentage, 3.0 to 6.0% Mg and 0.4 to 0.8% Mn, with the balance being Al and incidental impurities;

hot rolling the homogenized ingot to a sheet;

cold rolling the hot-rolled sheet at a rolling reduction of at least 20%;

intermediate heat treating the cold-rolled sheet at 200° to 250° C. for one hour or more; and final cold rolling the intermediate heat-treated sheet at a reduction of at least 50%.

In this process, the aluminum ingot may further contain from 0.05 to 0.4% Cu with or without 0.05 to 0.5% Si, 0.1 to 0.5% Fe, 0.01 to 0.05% Ti and 0.0001 to 0.0010% B.

Further, the above homogenizing and hot rolling steps may be replaced by the steps of homogenizing, hot rolling the homogenized ingot to a sheet thickness of 2 to 6 mm, cold rolling the hot-rolled sheet and annealing the cold-rolled sheet for recrystallization.

DETAILED DESCRIPTION OF THE PREFERRED EMBODIMENTS

The reasons for the limitations of the alloying elements and the processing conditions of the aluminum alloy according to the present invention will be described in detail hereinbelow.

Mg: Mg is an main additive element of the aluminum alloy of the present invention and contributes to enhancement of the strength. Addition of Mg of less than 3.0% cannot provide the required strength level. When the addition exceeds 6%, cracking is apt to occur during hot rolling step.

Mn: Mn is an essential additive element for improving the thermal stability. When the Mn addition is less than 0.4%, the effect cannot be sufficiently obtained. When the Mn addition exceeds 0.8%, the hot-rolling workability deteriorates and formation of coarse Al—Fe—Mn intermetallic compounds tends to occur during casting, thereby lowering the formability of the hardened sheet.

Cu: Cu, like Mn, improves the thermal stability. Especially, Cu forms fine precipitates during baking a coating material and, thereby, suppresses transfer of dislocations. A Cu addition exceeding 0.4% is unfavorable, since cracking occurs during hot rolling. On the other hand, when the addition is less than 0.05%, the effects cannot be obtained.

Si: Si forms compounds ($Mg_2Si$) in combination with Mg during baking and is effective for increasing the strength of the material. However, Si is unfavorable for the formability of the material. In the present invention, the addition should be controlled to low levels, preferably in the range of 0.05 to 0.5%. In order to reduce the Si content below 0.05%, a high degree of purification is needed for an aluminum metal. Such a high purification process is disadvantageous in view of cost. An addition of Si exceeding 0.5% leads to a deterioration of the formability.

Fe: Fe forms course compounds of Al—Fe—Mn during casting, thereby lowering the formability. In the present invention, the Fe content is desirably controlled to a low level, preferably in the rage of 0.1 to 0.5%. However, in order to suppress the Fe content below 0.1%, a starting aluminum metal should be highly purified. Such a high purification process increases the production cost. An excessive Fe content of more than 0.5% results in a deterioration of the formability.

Ti: Ti has an effect of refining the cast structure and, thereby, effectively serves to improve the rolling and forming properties of the hardened sheet. When the addition of Ti is less than 0.01%, the foregoing effect cannot be sufficiently obtained. When the addition of Ti exceeds 0.05%, Ti forms a coarse compound ($TiB_2$) with B and induces serious defects, such as pinholes.

B: B, like Ti, has an effect of refining the cast structure. When the addition of B is less than 0.0001%, the effect is insufficient. When the addition exceeds 0.0010%, B forms a coarse compound ($TiB_2$) with Ti and brings about serious problems, such as pinholes.

In practicing the production process according to the present invention, the above-specified aluminum alloy is cast into an ingot in a conventional manner, and then subjected to a homogenizing treatment for the purpose of removal of segregation of solute atoms prior to hot rolling. The homogenizing treatment is usually performed at 480° to 530° C. for 3 to 10 hours.

Hot-rolling is usually started by heating the ingot to about 500° C. and completed at a temperature (>280° C.) higher than the recrystallization temperature. This hot-rolling step may be replaced by the following hot-rolling and cold-rolling steps followed by annealing for recrystallization. These steps are indicated by an asterisk mark (*).

Hot rolling*:

The starting temperature should not exceed 530° C., because a too high starting temperature lowers the formability due to eutectic melting and formation of coarse recrystallized grains. A low starting temperature is desirable for the formability because finely recrystallized grains are formed. However, in this case, the productivity becomes too low and unacceptable for the industrial scale production. Further, since such a too low starting temperature will also lower the finishing temperature, its lower limit is 400° C. The hot rolling operation is preferably completed at a temperature of more than the crytallization temperature (280° C) with a thin gauge. When the aluminum alloy material after the hot rolling has an uncrystallized structure or has a large sheet thickness, the earing ratio of the final sheet product will be unfavorably large. Further, when the hot-rolled sheet material is too thick, the productivity is industrially unacceptably low. Therefore, the material of the present invention is hot-rolled to a thickness not exceeding 6 mm. On the other hand, when the material is hot rolled to a sheet thickness of less than 2 mm, the finishing temperature becomes unacceptably low and the rolling properties will deteriorate. Also, the earing ratio of the final sheet product becomes too large because of the presence of an unacceptably high percentage of uncrystallized phases.

Cold rolling* and annealing for recrystallization*:

After the above-mentioned hot rolling to a sheet thickness of 2 to 6 mm, cold rolling and annealing for recrystallization are carried out. The earing ratio, strength and formability of the finished sheet product are greatly influenced by the total cold rolling reduction after this annealing step. The total cold rolling reduction (reduction rate in thickness) is at least 60% with the preferred range being 75 to 85%. An excessive cold rolling reduction of more than 95% leads to an increased earing ratio and a poor formability in the finished sheet product. Therefore, the cold rolling following immediately after the hot rolling should be carried out so as to obtain a certain predetermined thickness taking account of the foregoing total cold-rolling reduction. The heat treatment for recrystallization is necessary to adjust the earing ratio, strength and formability, etc., of the finished sheet product. This heat treatment can be sufficiently performed by a box annealing process (or a batch-type annealing process) in which a material is maintained at 300° to 450° C. for 30 minutes or more; or by a continuous strip annealing process in which a coiled strip material is continuously rewound and passed through a continuous furnace in such a manner that the material is maintained at 400° to 530° C. for a period of at least 5 seconds. Both annealing processes can be used without causing any substantial problem, although the latter annealing process provides a finer recrystallized structure and a more superior earing ratio as compared with the former annealing process.

Cold rolling before intermediate heat treatment:

After the foregoing hot rolling or the successive steps of the hot rolling, cold rolling and intermediate annealing for recrystallization, a cold rolling step with a reduction of at least 20% is required in order to form uniformly fine precipitates of Al—Mn compounds during the subsequent intermediate heat treatment. Since a cold-rolling reduction of less than 20% cannot provide sufficient precipitation sites, uniform precipitation cannot be achieved.

Intermediate heat treatment:

In order to precipitate fine Al—Mn compounds among crystal grains, the heat treatment is carried out at a low temperature of 200° to 250° C. for a period of at least one hour. When the temperature of this heat treatment is less than 200° C., a longer heating time is required. Therefore, such a too low temperature is industrially disadvantageous.

On the other hand, when the heating temperature exceeds 250° C., recovery of dislocations, formed during the preceding cold rolling, takes place more rapidly than the precipitation of the Al—Mn compounds. Therefore, precipitation sites for the Al—Mn compounds disappear and, as a result, uniform and fine precipitation cannot be achieved and any sufficient effect cannot be expected.

When the holding temperature is in the range of 200° to 250° C., uniform and fine precipitates of the Al—Mn compounds can be obtained for a holding time of at least one hour. However, even if the holding time exceeds 24 hours, no further effect can be obtained. Therefore, such a too prolonged time is rather disadvantageous from the industrial view point.

Final cold rolling:

This step has an effect of increasing the strength as can end materials. When the cold rolling reduction is less than 50%, this effect cannot be obtained. However, a rolling reduction exceeding 93.75% unfavorably lowers the formability and the earing ratio of the resultant can end stock material.

Final heat treatment and coating:

When the hardened sheet produced by the process as specified above is used for the fabrication of beverage can ends, coating of an anticorrosive paint, adhering of a polymer resin film, printing or the like is conducted on the sheet.

If residual stress induced in the material by the preceding cold rolling operations is not uniform, heat treatments for drying or curing associated with the coating, adhering or printing will bring about serious warping and distortion in the sheet material. In order to avoid such problems, the cold-rolled hardened sheet may be heated to relieve the above-mentioned nonuniform residual stress. The heat-treatment for this purpose is preferably carried out at the same temperature level as the heating temperature of the foregoing heat treatments required for the coating or the like or at lower temperatures, that is, 300° C. or less, for example, at 150° to 200° C., for a period of several hours.

The heat treatment for stress relief can be performed in a continuous heating furnace used for a strip material. When drying, heat curing or similar heat treatment associated with coatings is carried out in the continuous heating furnace, while applying tension to the strip, such heat treatment is also useful as the stress-relieving heat-treatment.

This invention will be illustrated in more detail with reference to examples.

EXAMPLE 1

Each of aluminum alloys having the compositions as shown in Table 1 was cast into an ingot by a usual DC (direct chill) casting method. Each ingot was homogenized at 500° C. for 6 hours and hot-rolled to provide a 3.0 mm thick sheet in such a manner that the starting temperature was 480° C. and the finishing temperature was 300° C. Thereafter, the hot-rolled sheet was subjected to cold rolling to a sheet thickness of 1 mm (rolling reduction: 66.7%), intermediate heat treatment and final cold rolling to a sheet thickness of 0.3 mm (rolling reduction: 70%). The thus obtained cold-rolled materials were tested both in the as-cold-rolled state and after heating at a temperature of 300° C., which is the highest temperature used in the baking stage of an anticorrosive coating, for a period of 20 seconds or after heating at a temperature of 450° C., which is the temperature for complete recrystallization, i.e., for full annealing, for a period of 30 seconds. The respective materials were examined on precipitates formed therein as well as on their mechanical properties. Softening degrees were calculated from the yield strength values obtained from the tensile strength measurements, using the following equation.

Softening degree (%)=100×(yield strength of the as-cold-rolled material−yield strength of the material heated at 300° C.)/(yield strength of the as-cold-rolled material−yield strength of the material heated at 450° C.)

The thus obtained softening degree was used to predict the possibility of softening of the material during the baking of the anticorrosive coating. The reason why the heating temperatures of 300° C. and 450° C. were employed is that these temperatures are the highest baking temperature for the coatings applied to the materials and the temperature to completely recrystallize the materials, respectively. In the present invention, the greater (at most 100%) the softening degree, the lower the thermal stability. In contrast to this, the smaller the softening degree, the better the thermal stability. The test results are shown in Table 1.

TABLE 1

| Sample No. | Mg | Mn | Cu | Al | Pretreatment before testing | Yield strength MPa | Tensile strength MPa | Elongation % | Softening degree % |
|---|---|---|---|---|---|---|---|---|---|
| a1 | 4.9 | 0.65 | — | Bal. | as-cold-rolled | 427 | 461 | 6 | |
| | | | | | 300° C. × 20 sec | 281 | 373 | 14 | 54.9 |
| | | | | | 450° C. × 30 sec | 161 | 323 | 28 | |
| a2 | 4.9 | 0.45 | 0.35 | Bal. | as-cold-rolled | 392 | 422 | 5 | |
| | | | | | 300° C. × 20 sec | 272 | 363 | 14 | 50.4 |
| | | | | | 450° C. × 30 sec | 154 | 312 | 26 | |
| a3 | 3.6 | 0.65 | 0.15 | Bal. | as-cold-rolled | 390 | 421 | 4 | |
| | | | | | 300° C. × 20 sec | 270 | 361 | 14 | 49.8 |
| | | | | | 450° C. × 30 sec | 149 | 303 | 25 | |
| a4 | 4.9 | 0.64 | 0.20 | Bal. | as-cold-rolled | 429 | 465 | 6 | |
| | | | | | 300° C. × 20 sec | 292 | 379 | 14 | 51.5 |
| | | | | | 450° C. × 30 sec | 163 | 326 | 28 | |
| a5 | 4.95 | 0.35 | 0.02 | Bal. | as-cold-rolled | 406 | 440 | 4 | |
| | | | | | 300° C. × 20 sec | 249 | 346 | 16 | 61.3 |
| | | | | | 450° C. × 30 sec | 150 | 306 | 25 | |
| a6 | 2.7 | 0.30 | 0.05 | Bal. | as-cold-rolled | 332 | 360 | 4 | |
| | | | | | 300° C. × 20 sec | 201 | 306 | 20 | 64.1 |
| | | | | | 450° C. × 30 sec | 127 | 272 | 24 | |
| a7 | 5.1 | 0.45 | 0.60 | Bal. | Tests were not done because of occurrence of cracking during hot rolling. | | | | |
| a8 | 6.3 | 0.82 | 0.03 | Bal. | Tests were not done because of occurrence of cracking during hot rolling. | | | | |

Nos. a1–a4: Materials of the present invention
Nos. a5–a8: Comparative materials Samples Nos. a1–a4 of the present invention showed that most of the precipitates in crystal grains had a size of 0.05 μm or less. They had a tensile strength (yield strength measured after the thermal exposure to 300° C. for 20 seconds; the same shall apply hereinafter) of at least 270 MPa. Further, these inventive materials had a softening degree of not more than 54.9% so that they had a superior thermal stability.

On the other hand, No. a5 had a large softening degree of 61.3% due to its inadequate Mn content of 0.35% and had a poor thermal stability.

Since No. a6 had insufficient Mg and Mn contents, i.e., 2.7% Mg and 0.3% Mn, it showed a low tensile strength of 201 MPa and an insufficient thermal stability, i e., a high softening degree of 64.1%.

Samples Nos. a7 and a8, were subjected to cracking during hot rolling, because No. a7 had a high Cu content of 0.60% and No. a8 had too high Mg and Mn contents, i.e., Mg 6.3% and Mn 0.82%. Therefore, the tests were halted.

EXAMPLE 2

Each of the materials numbered Nos. a1 and a3 as shown in Table 1 was cast into an ingot by the usual DC casting method, homogenized at 500° C. for 6 hours. Hot rolling was started at 480° C. and each material was hot-rolled to a sheet thickness of 4.0 mm. Then, each hot-rolled material was subjected to cold rolling, intermediate heat-treatment and finishing cold rolling under the conditions specified in Table 2 and Table 3. The conditions shown in Table 2 were employed to obtain materials according to the present invention and the conditions shown in Table 3 were employed to obtain comparative materials. The same tests as in described Example 1 were conducted for each sample of the thus obtained materials as well as measurements of Erichsen values. The test results are shown in Table 2 and Table 3. Samples Nos. a9–a13 shown in Table 2 and Samples Nos. a16 to a20 were prepared from Sample No. a1 shown in Table 1 and Sample Nos. a14 and a15 in Table 2 and a21 and a22 in Table 3 were prepared from Sample No. a3 in Table 1.

TABLE 2

| | | | | (Test Results of the Materials of the Invention) | | | | | |
|---|---|---|---|---|---|---|---|---|---|
| Sample No. | Cold rolling reduction % | Intermediate heat-treatment temp. (°C.) × time (hr) | Final cold rolling reduction % | Final heat treatment before testing | Yield strength MPa | Tensile strength MPa | Elongation % | Softening degree % | Erichsen Value mm |
| a9 | 20 | 200° C. × 8 hr | 50 | as-cold-rolled | 395 | 445 | 7 | | 5.0 |
| | | | | 300° C. × 20 sec | 265 | 360 | 15 | 55.8 | 5.7 |
| | | | | 450° C. × 30 sec | 162 | 325 | 28 | | 6.8 |
| a10 | 50 | 250° C. × 8 hr | 70 | as-cold-rolled | 430 | 466 | 6 | | 4.9 |
| | | | | 300° C. × 20 sec | 286 | 376 | 14 | 53.3 | 5.5 |
| | | | | 450° C. × 30 sec | 160 | 321 | 28 | | 6.8 |
| a11 | 50 | 230° C. × 8 hr | 70 | as-cold-rolled | 430 | 465 | 6 | | 4.9 |
| | | | | 300° C. × 20 sec | 289 | 379 | 15 | 52.2 | 5.6 |
| | | | | 450° C. × 30 sec | 160 | 321 | 28 | | 6.8 |
| a12 | 75 | 230° C. × 8 hr | 60 | as-cold-rolled | 412 | 455 | 7 | | 5.0 |
| | | | | 300° C. × 20 sec | 279 | 370 | 15 | 53.6 | 5.6 |
| | | | | 450° C. × 30 sec | 164 | 325 | 27 | | 6.8 |
| a13 | 50 | 230° C. × 8 hr | 50 | as-cold-rolled | 397 | 446 | 7 | | 5.0 |
| | | | | 300° C. × 20 sec | 268 | 365 | 15 | 54.4 | 5.7 |
| | | | | 450° C. × 30 sec | 160 | 323 | 28 | | 6.9 |
| a14 | 50 | 250° C. × 8 hr | 70 | as-cold-rolled | 388 | 421 | 5 | | 4.8 |
| | | | | 300° C. × 20 sec | 269 | 360 | 14 | 50.0 | 5.4 |
| | | | | 450° C. × 30 sec | 150 | 304 | 25 | | 6.5 |
| a15 | 20 | 200° C. × 8 hr | 60 | as-cold-rolled | 370 | 410 | 6 | | 4.8 |
| | | | | 300° C. × 20 sec | 260 | 356 | 15 | 50.5 | 5.4 |
| | | | | 450° C. × 30 sec | 152 | 305 | 25 | | 6.5 |

a9–a15: Materials of the present invention

TABLE 3

| (Comparative Material) | | | | (Test Results of the Comparative Materials) | | | | | |
|---|---|---|---|---|---|---|---|---|---|
| Sample No. | Cold rolling reduction | Intermediate heat-treatment temp. (°C.) × time (hr) | Final cold rolling reduction % | Final heat treatment before testing | Yield strength MPa | Tensile strength MPa | Elongation % | Softening degree % | Erichsen Value mm |
| a16 | 10 | 230° C. × 8 hr | 70 | as-cold-rolled | 395 | 444 | 7 | | 5.0 |
| | | | | 300° C. × 20 sec | 250 | 355 | 18 | 62.8 | 5.9 |
| | | | | 450° C. × 30 sec | 164 | 326 | 28 | | 6.8 |
| a17 | 15 | 230° C. × 8 hr | 70 | as-cold-rolled | 395 | 445 | 7 | | 5.0 |
| | | | | 300° C. × 20 sec | 255 | 357 | 18 | 60.1 | 5.9 |
| | | | | 450° C. × 30 sec | 162 | 325 | 28 | | 6.9 |
| a18 | 50 | 300° C. × 8 hr | 70 | as-cold-rolled | 380 | 418 | 7 | | 5.0 |
| | | | | 300° C. × 20 sec | 245 | 340 | 19 | 61.4 | 5.9 |
| | | | | 450° C. × 30 sec | 160 | 320 | 28 | | 6.9 |
| a19 | 50 | 180° C. × 8 hr | 70 | as-cold-rolled | 397 | 445 | 6 | | 4.9 |
| | | | | 300° C. × 20 sec | 253 | 355 | 17 | 61.3 | 5.9 |
| | | | | 450° C. × 30 sec | 162 | 325 | 27 | | 6.8 |
| a20 | 75 | 230° C. × 8 hr | 40 | as-cold-rolled | 390 | 435 | 7 | | 5.0 |
| | | | | 300° C. × 20 sec | 246 | 342 | 19 | 62.6 | 6.0 |
| | | | | 450° C. × 30 sec | 160 | 320 | 28 | | 6.9 |
| a21 | 10 | 200° C. × 8 hr | 60 | as-cold-rolled | 368 | 410 | 6 | | 4.8 |
| | | | | 300° C. × 20 sec | 238 | 340 | 17 | 60.2 | 5.7 |
| | | | | 450° C. × 30 sec | 152 | 306 | 25 | | 6.5 |
| a22 | 30 | 400° C. × 8 hr | 70 | as-cold-rolled | 365 | 405 | 7 | | 4.9 |
| | | | | 300° C. × 20 sec | 225 | 332 | 20 | 64.8 | 6.0 |
| | | | | 450° C. × 30 sec | 149 | 305 | 25 | | 6.5 |

The inventive materials numbered Nos. a9–a15 had a tensile strength (yield strength measured after thermal exposure of 300° C. for 20 seconds; the same shall apply hereinafter) of at least 260 MPa and a good thermal stability because of their small softening degrees not exceeding 55.8%.

On the other hand, the comparative materials of Nos. a16 and a17 showed an inferior thermal stability, i.e., a high softening degrees of 62.8% for No. a16 and 60.1% for a17, respectively, because they were cold-rolled at insufficient rolling reductions of 10% (No. a16) and 15% (No. a17) before the intermediate heat treatment.

Since No. a18 was subjected to a high-temperature intermediate annealing at 300° C., it had a large softening degree of 61.4% so that it had a poor thermal stability.

No. a19 had a large softening degree of 61.3% and showed a poor thermal stability because of a low intermediate annealing temperature of 180° C.

No. a20 had a large softening degree of 62.6% and exhibited a poor thermal stability, because of an insufficient final cold rolling reduction of 40%.

No. a21 was cold-rolled at a low rolling reduction of 10% before the intermediate heat treatment and No. a22 was intermediate-annealed at a high temperature of 400° C. Although these comparative samples were different in their composition from the other comparative samples, their softening degrees were large. Therefore, these samples also exhibited a poor thermal stability.

EXAMPLE 3

An aluminum alloy No. b1 shown in Table 4 was cast by the usual DC casting and fabricated into a sheet under the processing conditions as specified in Table 5. In all of the processing conditions, homogenizing was carried out at 500° C. for 8 hours. The thus obtained cold-rolled materials were tested both in the as-cold-rolled condition and after heating at a temperature of 300° C. for a period of 20 seconds or after heating at a temperature of 480° C. for a period of 30 seconds. The heating temperatures of 300° C. and 480° C. were employed for the same reason as described in Example 1. The softening degrees of the respective materials were obtained in the same way as set forth in Example 1 and were evaluated similarly to Example 1.

The test results are shown in Table 6. The earing percentages at 45° in four directions were measured at a blank diameter of 55 mm, using a flat bottom punch having a diameter of 33 mm.

TABLE 4

| | Chemical composition (wt. %) | | | | | | | |
|---|---|---|---|---|---|---|---|---|
| Sample No. | Mg | Mn | Cu | Si | Fe | Ti | B | Al |
| b1 | 4.7 | 0.45 | 0.14 | 0.13 | 0.28 | 0.03 | 0.0002 | bal. |

TABLE 5

| | Processing Conditions | | | | | | | |
|---|---|---|---|---|---|---|---|---|
| | Hot rolling | | | | | | | |
| No. | Starting temp. (°C.) | Finishing temp. (°C.) | Sheet thickness after hot-rolling (mm) | Cold rolling reduction (%) | Intermediate annealing temp. (°C.) × time (hr) | Cold rolling reduction (%) | Intermediate heat treatment temp. (°C.) × time (hr) | Final cold rolling reduction (%) |
| A | 480 | 310 | 3.2 | 32 | 350° C. × 1 hr | 25 | 225° C. × 4 hr | 80 |
| B | 500 | 310 | 3.0 | 33 | 350° C. × 1 hr | 70 | 250° C. × 1 hr | 50 |
| C | 500 | 290 | 2.8 | 36 | 450° C. × 30 sec | 50 | 200° C. × 6 hr | 70 |
| D | 500 | 340 | 4.5 | 55 | 450° C. × 30 sec | 50 | 200° C. × 10 hr | 75 |
| E | 450 | 310 | 6.0 | 70 | 350° C. × 1 hr | 40 | 230° C. × 6 hr | 75 |
| F | 500 | 320 | 2.9 | 31 | 350° C. × 1 hr | 10 | 230° C. × 8 hr | 80 |
| G | 500 | 340 | 6.0 | 25 | 450° C. × 30 sec | 80 | 200° C. × 6 hr | 70 |
| H | 500 | 330 | 3.0 | 33 | 450° C. × 30 sec | 50 | 350° C. × 10 hr | 75 |
| I | 370 | 240 | 3.0 | 33 | 450° C. × 30 sec | 50 | 230° C. × 8 hr | 75 |
| J | 480 | 320 | 4.5 | 55 | 450° C. × 30 sec | 10 | 200° C. × 10 hr | 85 |
| K | 480 | 320 | 4.5 | 55 | 350° C. × 1 hr | 80 | 250° C. × 12 hr | 30 |

A-E: Processing conditions of the present invention
F-K: Processing conditions for comparison

TABLE 6

| | Test Results on Properties of Finished Sheets | | | | | | |
|---|---|---|---|---|---|---|---|
| No. | Pretreatment before Tests | Yield strength MPa | Tensile Strength MPa | Elongation % | Erichsen Value mm | Softening Degree % | Earing percentage 45°-four directions % |
| A | as-cold-rolled | 387 | 420 | 5 | — | | |
| | 300° C. × 20 sec | 302 | 390 | 12 | 5.6 | 35.9 | 4.5 |
| | 450° C. × 30 sec | 150 | 309 | 27 | — | | |
| B | as-cold-rolled | 388 | 425 | 5 | — | | |
| | 300° C. × 20 sec | 300 | 390 | 12 | 5.6 | 37.0 | 4.5 |
| | 450° C. × 30 sec | 150 | 309 | 27 | — | | |
| C | as-cold-rolled | 387 | 420 | 5 | — | | |
| | 300° C. × 20 sec | 298 | 388 | 11 | 5.5 | 37.6 | 4.5 |
| | 450° C. × 30 sec | 150 | 310 | 27 | — | | |
| D | as-cold-rolled | 393 | 425 | 5 | — | | |
| | 300° C. × 20 sec | 305 | 396 | 12 | 5.6 | 36.5 | 4.6 |
| | 450° C. × 30 sec | 152 | 312 | 28 | — | | |
| E | as-cold-rolled | 386 | 418 | 5 | — | | |
| | 300° C. × 20 sec | 298 | 385 | 12 | 5.6 | 37.3 | 4.5 |
| | 450° C. × 30 sec | 150 | 308 | 27 | — | | |
| F | as-cold-rolled | 395 | 425 | 4 | — | | |
| | 300° C. × 20 sec | 257 | 355 | 14 | 5.7 | 56.3 | 4.4 |
| | 450° C. × 30 sec | 150 | 310 | 27 | — | | |
| G | as-cold-rolled | 408 | 430 | 2 | — | | |
| | 300° C. × 20 sec | 320 | 398 | 11 | 5.5 | 34.5 | 6.5 |
| | 450° C. × 30 sec | 153 | 312 | 27 | — | | |
| H | as-cold-rolled | 380 | 418 | 6 | — | | |
| | 300° C. × 20 sec | 246 | 345 | 18 | 5.8 | 58.5 | 4.7 |

TABLE 6-continued

| No. | Pretreatment before Tests | Test Results on Properties of Finished Sheets: Yield strength MPa | Tensile Strength MPa | Elongation % | Erichsen Value mm | Softening Degree % | Earing percentage 45°-four directions % |
|---|---|---|---|---|---|---|---|
| | 450° C. × 30 sec | 151 | 310 | 27 | — | | |
| I | as-cold-rolled | 398 | 426 | 4 | — | | |
| | 300° C. × 20 sec | 305 | 396 | 12 | 5.5 | 37.5 | 6.0 |
| | 450° C. × 30 sec | 150 | 310 | 27 | — | | |
| J | as-cold-rolled | 389 | 421 | 5 | — | | |
| | 300° C. × 20 sec | 258 | 357 | 14 | 5.7 | 54.8 | 4.6 |
| | 450° C. × 30 sec | 150 | 312 | 28 | — | | |
| K | as-cold-rolled | 385 | 415 | 5 | — | | |
| | 300° C. × 20 sec | 250 | 353 | 14 | 5.7 | 57.0 | 4.5 |
| | 450° C. × 30 sec | 148 | 309 | 26 | — | | |

A–E: Materials of the Invention
F–K: Comparative Materials

The material of the present invention had a yield strength of not less than 290 MPa after the heat treatment at 300° C. and an excellent thermal stability, i.e., a small softening degree not exceeding 50%.

The comparative materials had the following disadvantages:

Materials F and J provided softening degrees of not smaller than 50%, because the rolling reductions just before the intermediate heat treatment were small. A material G resulted in a large earing percentage of not less than 6%, because the finishing sheet thickness of the hot rolling stage was large. A material H had a softening degree of more than 50%, because the temperature of the intermediate heat treatment was too high. A material I had a earing percentage of not less than 6%, because the temperature of the hot rolling was too low. The yield strength of a material K was only 250 MPa after the treatment at 300° C. and the softening degree was not less than 50%.

EXAMPLE 4

Each of aluminum alloys having the compositions as listed in Table 7 was cast into an ingot by the usual DC casting process, homogenized at 500° C. for 8 hours and hot-rolled to provide a 3.2 mm thick sheet in such a manner that the starting temperature was 480° C. and the finishing temperature was 320° C. Subsequently, the hot-rolled sheet was cold-rolled to a 2.0 mm thick sheet. The cold-rolled sheet was then subjected to an annealing treatment for recrystallization including heating up at a heating rate of 20° to 50° C./hour, holding at 350°±10° C. for 2 hours and air-cooling. Subsequently, the annealed sheet was subjected to cold rolling to a sheet thickness of 1.0 mm (rolling reduction of 50%), intermediate heat treatment at 200° C. for 10 hours and final cold rolling to a sheet thickness of 0.25 mm (rolling reduction of 75%).

The thus obtained cold-rolled materials were tested in the same way as described in Example 3. The test results are given in Table 8.

TABLE 7

| Sample No. | Chemical composition (wt. %): Mg | Mn | Cu | Si | Fe | Ti | B | Al |
|---|---|---|---|---|---|---|---|---|
| b2 | 4.8 | 0.46 | 0.13 | 0.12 | 0.30 | 0.03 | 0.0003 | Bal. |
| b3 | 4.0 | 0.65 | 0.30 | 0.35 | 0.20 | 0.03 | 0.0003 | Bal. |
| b4 | 5.6 | 0.42 | 0.08 | 0.20 | 0.42 | 0.02 | 0.0002 | Bal. |
| b5 | 3.2 | 0.73 | 0.06 | 0.08 | 0.15 | 0.02 | 0.0003 | Bal. |
| b6 | 4.4 | 0.55 | 0.06 | 0.56 | 0.70 | 0.02 | 0.0002 | Bal. |
| b7 | 5.0 | 0.32 | 0.03 | 0.20 | 0.25 | 0.03 | 0.0003 | Bal. |
| b8 | 4.5 | 0.90 | 0.45 | 0.15 | 0.30 | 0.01 | 0.0001 | Bal. |
| b9 | 2.5 | 0.35 | 0.15 | 0.20 | 0.35 | 0.01 | 0.0001 | Bal. |
| b10 | 4.9 | 0.50 | 0.05 | 0.20 | 0.35 | 0.15 | 0.0040 | Bal. |

b2–b5: Materials of the Invention
b6–b10: Comparative Material

TABLE 8

| No. | Pretreatment before Tests | Test Results on Properties of Finished Sheets: Yield strength MPa | Tensile Strength MPa | Elongation % | Erichsen Value mm | Softening Degree % |
|---|---|---|---|---|---|---|
| b2 | as-cold-rolled | 390 | 422 | 5 | — | |
| | 300° C. × 20 sec | 305 | 395 | 12 | 5.6 | 35.4 |
| | 450° C. × 30 sec | 150 | 310 | 27 | — | |
| b3 | as-cold-rolled | 385 | 418 | 5 | — | |
| | 300° C. × 20 sec | 305 | 390 | 12 | 5.6 | 33.8 |
| | 450° C. × 30 sec | 148 | 310 | 26 | — | |
| b4 | as-cold-rolled | 420 | 465 | 4 | — | |
| | 300° C. × 20 sec | 326 | 395 | 11 | 5.4 | 35.3 |
| | 450° C. × 30 sec | 154 | 330 | 28 | — | |
| b5 | as-cold-rolled | 393 | 420 | 4 | — | |
| | 300° C. × 20 sec | 285 | 360 | 12 | 5.5 | 43.7 |
| | 450° C. × 30 sec | 146 | 300 | 26 | — | |
| b6 | as-cold-rolled | 391 | 418 | 4 | — | |
| | 300° C. × 20 sec | 260 | 356 | 9 | 5.0 | 54.4 |
| | 450° C. × 30 sec | 150 | 310 | 24 | — | |
| b7 | as-cold-rolled | 395 | 420 | 5 | — | |
| | 300° C. × 20 sec | 255 | 355 | 12 | 5.4 | 57.1 |
| | 450° C. × 30 sec | 150 | 311 | 26 | — | |
| b8 | as-cold-rolled | | | | | |
| | 300° C. × 20 sec | | | | | |
| | 450° C. × 30 sec | | | | | |
| b9 | as-cold-rolled | 330 | 360 | 4 | — | |
| | 300° C. × 20 sec | 200 | 305 | 20 | 5.8 | 63.1 |
| | 450° C. × 30 sec | 124 | 270 | 24 | — | |
| b10 | as-cold-rolled | | | | | |
| | 300° C. × 20 sec | | | | | |

TABLE 8-continued

| No. | Pretreatment before Tests | Test Results on Properties of Finished Sheets: Yield strength MPa | Tensile Strength MPa | Elongation % | Erichsen Value mm | Softening Degree % |
|---|---|---|---|---|---|---|
| | 450° C. × 30 sec | | | | | |

Nos. b2–b5: Materials the Present Invention
Nos. b6–b10: Comparative Materials

The materials of the present invention had a yield strength of not less than 280 MPa even after the thermal exposure to 300° C. and a low softening degree of not less than 50% so that they had an excellent thermal stability.

The comparative materials had the following disadvantages.

Since No. b6 contained excess Fe and Si, it had somewhat low elongation and Erichsen values and was inferior to the materials of the present invention in yield strength after the heat treatment at 300° C. and softening degree.

No. b7 had a high softening degree because of its inadequate Mn content.

No. b8 had too large Mn and Cu contents and cracking occurred during the hot-rolling step. Therefore, the subsequent tests were halted.

Since No. b9 contained Ti and B in insufficient amounts, it had a low yield strength after the heat treatment at 300° C. and its softening degree was highest.

Since the Ti content and B content of No. b10 were both excessive, a coarse $TiB_2$ compound was formed and pinholes (through holes) were observed in the final cold-rolled sheet product.

As described above, the aluminum alloy sheet material of the present invention intended for use in can ends of beverage cans for coffee, oolong tea or the like can be successfully coated with an anticorrosive coating material or the like and baked without any substantial strength loss. Accordingly, a high-strength coated sheet can be obtained.

Further, in the present invention, thickness reduction is possible and hardened materials having good formability can be obtained.

We claim:

1. A method of producing a hardened aluminum alloy sheet having superior thermal stability, the method comprising the steps of:

homogenizing an ingot of an aluminum alloy consisting essentially of, in weight percentage, 3.0 to 6.0% Mg and 0.4 to 0.8% Mn, with the balance being Al and incidental impurities;

hot rolling the homogenized ingot to a sheet;

cold rolling the hot-rolled sheet at a rolling reduction of at least 20%;

intermediate heat treating the cold-rolled sheet at 200° to 250° C. for one hour or more; and final cold rolling the intermediate heat-treated sheet at a reduction of at least 50%.

2. A method of producing a hardened aluminum alloy sheet having superior thermal stability, the method comprising the steps of:

homogenizing an ingot of an aluminum alloy consisting essentially of, in weight percentage, 3.0 to 6.0% Mg and 0.4 to 0.8% Mn, with the balance being Al and incidental impurities;

hot rolling the homogenized ingot to a sheet thickness of 2 to 6 mm;

cold rolling the hot-rolled sheet followed by annealing for recrystallization;

cold rolling the annealed sheet at a rolling reduction of at least 20%;

intermediate heat treating the cold-rolled sheet at 200° to 250° C. for one hour or more; and final cold rolling the intermediate heat-treated sheet at a reduction of at least 50%.

3. A method of producing a hardened aluminum alloy sheet having superior thermal stability, the method comprising the steps of:

homogenizing an ingot of an aluminum alloy consisting essentially of, in weight percentage, 3.0 to 6.0% Mg, 0.4 to 0.8% Mn and 0.05 to 0.4% Cu, with the balance being Al and incidental impurities;

hot rolling the homogenized ingot to a sheet;

cold rolling the hot-rolled sheet at a rolling reduction of at least 20%;

intermediate heat treating the cold-rolled sheet at 200° to 250° C. for one hour or more; and final cold rolling the intermediate heat-treated sheet at a reduction of at least 50%.

4. A method of producing a hardened aluminum alloy sheet having superior thermal stability, the method comprising the steps of:

homogenizing an ingot of an aluminum alloy consisting essentially of, in weight percentage, 3.0 to 6.0% Mg, 0.4 to 0.8% Mn and 0.05 to 0.4% Cu, with the balance being Al and incidental impurities;

hot rolling the homogenized ingot to a sheet thickness of 2 to 6 mm;

cold rolling the hot-rolled sheet followed by annealing for recrystallization;

cold rolling the annealed sheet at a rolling reduction of at least 20%;

intermediate heat treating the cold-rolled sheet at 200° to 250° C. for one hour or more; and final cold rolling the intermediate heat-treated sheet at a reduction of at least 50%.

5. A method of producing a hardened aluminum alloy sheet having superior thermal stability, the method comprising the steps of:

homogenizing an ingot of an aluminum alloy consisting essentially of, in weight percentage, 3.0 to 6.0% Mg, 0.4 to 0.8% Mn, 0.05 to 0.4% Cu, 0.05 to 0.5% Si, 0.1 to 0.5% Fe, 0.01 to 0.05% Ti and 0.0001 to 0.0010% B, with the balance being Al and incidental impurities;

hot rolling the homogenized ingot to a sheet;

cold rolling the hot-rolled sheet at a rolling reduction of at least 20%;

intermediate heat treating the cold-rolled sheet at 200° to 250° C. for one hour or more; and final cold rolling the intermediate heat-treated sheet at a reduction of at least 50%.

6. A method of producing a hardened aluminum alloy sheet having superior thermal stability, the method comprising the steps of:

homogenizing an ingot of an aluminum alloy consisting essentially of, in weight percentage, 3.0 to 6.0% Mg, 0.4 to 0.8% Mn, 0.05 to 0.4% Cu, 0.05 to 0.5% Si, 0.1 to 0.5% Fe, 0.01 to 0.05% Ti and 0.0001 to 0.0010% B, with the balance being Al and incidental impurities;

hot rolling the homogenized ingot to a sheet thickness of 2 to 6 mm;

cold rolling the hot-rolled sheet followed by annealing for recrystallization;

cold rolling the annealed sheet at a rolling reduction of at least 20%;

intermediate heat treating the cold-rolled sheet at 200° to 250° C. for one hour or more; and final cold rolling the intermediate heat-treated sheet at a reduction of at least 50%.

7. A method as claimed in claim 1 in which a heat treatment was carried out at temperature of not more than 300° C. after the final cold rolling.

8. A method as claimed in claim 2 in which a heat treatment was carried out at temperature of not more than 300° C. after the final cold rolling.

9. A method as claimed in claim 3 in which a heat treatment was carried out at temperature of not more than 300° C. after the final cold rolling.

10. A method as claimed in claim 4 in which a heat treatment was carried out at temperature of not more than 300° C. after the final cold rolling.

11. A method as claimed in claim 5 in which a heat treatment was carried out at temperature of not more than 300° C. after the final cold rolling.

12. A method as claimed in claim 6 in which a heat treatment was carried out at temperature of not more than 300° C. after the final cold rolling.

* * * * *